United States Patent [19]

Juan

[11] Patent Number: 4,670,920

[45] Date of Patent: Jun. 9, 1987

[54] APPARATUS FOR ASSISTING IN BOWEL EVACUATION

[76] Inventor: Chung W. Juan, 142 S. Wolf Rd., Apt. E, Northlake, Ill. 60164

[21] Appl. No.: 830,090

[22] Filed: Feb. 18, 1986

[51] Int. Cl.[4] ..... A47K 3/00

[52] U.S. Cl. ..... 4/661; 4/420.3; 4/420.4; 4/446; 4/447

[58] Field of Search ..... 4/443–448, 4/420.1–420.5, 661; 128/65, 66; 604/317, 322

[56] References Cited

U.S. PATENT DOCUMENTS

| | | | |
|---|---|---|---|
| 2,427,807 | 9/1947 | Oliver | 4/445 |
| 2,632,179 | 3/1953 | Trotter | 128/66 X |
| 3,288,140 | 11/1966 | McCarthy | 4/420.1 X |
| 3,577,567 | 5/1971 | Wintercorn | 4/420.1 X |
| 3,795,015 | 3/1974 | Talge et al. | 4/420.3 |

FOREIGN PATENT DOCUMENTS

| | | | |
|---|---|---|---|
| 912432 | 8/1946 | France | 4/420.3 |
| 1387728 | 12/1964 | France | 4/420.3 |
| 465094 | 8/1951 | Italy | 4/420.3 |

*Primary Examiner*—Charles E. Phillips
*Attorney, Agent, or Firm*—Robert J. Black

[57] ABSTRACT

Apparatus for assisting in the evacuation of the bowel and sigmoid colon consisting of a framelike structure supporting a container of warm water so positioned that the anus of the user is submersed in the water. Adapted for use on a flush toilet, connections are included to a source of warm water. Also included as a part of the water container are means for emptying the container into the associated toilet while the apparatus is in use.

11 Claims, 4 Drawing Figures

APPARATUS FOR ASSISTING IN BOWEL EVACUATION

BACKGROUND OF THE INVENTION

1. Field of the Invention

The present invention relates to a method of assisting the defecation mechanism in the ano-rectal region and promotion function of that mechanism and more particularly to apparatus for use in providing such assistance.

2. Background Art

One of the most common ailments of mankind has for centuries been recognized as constipation. The causes of unsuccessful evacuation or functional constipation frequently include such things as poor circulation in the ano-rectal region, weak ano-rectal muscles, intestinal gas, lack of coordination of the defecation mechanism of the ano-rectal region, hard feces and incomplete previous evacuation.

It has been determined that the immediate causes of functional constipation are closely related, inasmuch as the ano-rectal region is very rich in blood vessels, blood circulation in the particular region is a very important function. However, circulation may be restrained in this region by the presence of excessive waste matter in the sigmoid colan and rectum. Likewise, successful evacuation of waste matter out of the sigmoid colan and rectum is possible only when the ano-rectal muscles are in good physical condition. That is to say that they are healthy and strong enough to stand firm without flinching under the downward defecating force exerted by the defecation mechanism in the upper abdominal region so that force acts only on the waste matter in the sigmoid colon and rectum without loss of result in successful evacuation. Unfortunately, ano-rectal muscles are often weakened and fatigued and blood circulation in the region is worsened by the overloaded straining stool, causing the ano-rectal muscles to contract together holding the waste matter contents as a whole rather than permitting their evacuation. The effect of the downward defecating force exerted by the defecation mechanism in the upper abdominal region is of little avail if it results in providing little relief to the individual suffering from constipation. Another problem frequently associated with constipation is the presence of gas in the intestines. While there is always some gas in the intestines, the gas is compressible, thus, the presence of gas in the intestines especially in the sigmoid colon and rectum is able to frustrate successful evacuation of the waste matter contained therein. A considerable amount of gas will be eliminated out of the sigmoid colon and rectum as a matter of course when the ano-rectal muscles are functioning properly and blood circulation in the area is satisfactory.

Without proper functioning of the defecation mechanism in the ano-rectal region, there is no successful evacuation going to occur. Thus only when the ano-rectal muscles are in an easy, comfortable, relaxed sensitive and active state are they alert enough to give prompt, full organic systemic coordination in the defecation process. Unfortunately, straining to eliminate the stools contained therein weakens and fatigues the ano-rectal muscles and dampens their sensitivity and coordination depressing of restraining blood circulation in the ano-rectal region.

Yet another cause of functional constipation is the presence of hard feces. It is well recognized that hard waste matter is much more difficult to be eliminated than the soft. Similarly, incomplete previous evacuation is also a cause of constipation inasmuch as it freequently causes the waste matter that stays in the intestine when incomplete evacuation occurs to harden causing the difficulties in evacuation that occur with hard feces as noted above.

Many different techniques or compounds have been suggested and used in the past for relief of functional constipation. These include the use of laxatives, purges, enemas, suppositories, fibrous and filler diets, lubricants and even acupuncture. None of these techniques has been found to be completely successful in relieving the problems of functional constipation. Some techniques may be successful depending upon the cause behind the functional constipation while other techniques have proved virtually useless in all cases. Representative of some of the diverse techniques employed that aid the constipation sufferer are those found in U.S. Pat. No. 1,525,505 to G. L. Kavanagh and U.S. Pat. No. 2,099,118 to G. W. Kennedy. Accordingly, it is the object of the present invention to provide a new and useful method of assisting in the evacuation of the bowel and sigmoid colon and apparatus useful for providing or assisting in the provision of such technique.

SUMMARY OF THE INVENTION

The present invention consists basically of an adapter intended to be placed on a conventional toilet unit in place of the usual toilet seat. The adapter unit includes therein a bowl-like container in which a bath of warm water or similar aqueous solution is placed. The user then places him or herself in such a position that the anus is dipped into the liquid solution up to the end of the vertebrae (the coccyx bone) to effect defecation.

In the present embodiment, the bowl includes an opening against which a spring loaded stopper is located. The stopper can be withdrawn from the opening to allow the contents of the bowl to be emptied into the toilet at any time by operating a small ring which is connected by means of a cable to the stopper and located at the rear of the adapter unit. Also included in the adapter unit is a water supply connection which is adapted for connection to an adjacent sink or other source of warm water with the water supply element of the adapter having an opening therein which allows the water to be sprayed out in such a manner that the running warm water showers the user's acupuntural meridians of defecation.

Use of the warm water bath of the present invention provides a physical means that is unprecedented in its success for its use in inducing the reflex action necessary to promote local blood circulation in the ano-rectal region and to assist in the tremendous effort required for successful evacuation. In the present invention the user places himself on the adapter unit in such a manner that the anus is dipped up to and above the coccyx bone in the warm water so that the weakened anal rectal muscles are immediately supported from below by the water substance and strengthened through the promoted blood circulation in the muscles. This warm water bath provides an ideal support to such weakened ano-rectal muscles since it does not stop the outlet opening of the anus.

As noted previously, the warm water bowl-like container provides an opening of approximately 4" in diameter which has an automatic closing stopper which can be opened at any moment during evacuation to provide for emptying of the bowl. The running water can then refill the bowl all the time during evacuation and the warm water can be maintained in a clean condition. Adjacent to the bowl, channels are provided so that if the bowl becomes completely full the overflow will empty directly into the toilet itself.

When the user sits on the adapter unit with the anus dipped into the bath of warm water and with the running warm water showering the user's acupunctural meridians of defecation, the user will find the sensitive ano-rectal muscles responding to the comforting ambience offered by the bath of warm water which also improves the local blood circulation. It should also be noted that the water rises into the rectum between the wall of the rectum and any waste matter contained therein thus serving as a lubricant and softener of dry and/or hard feces. This results in more easy evacuation.

DESCRIPTION OF THE PREFERRED EMBODIMENT

Figure 1:
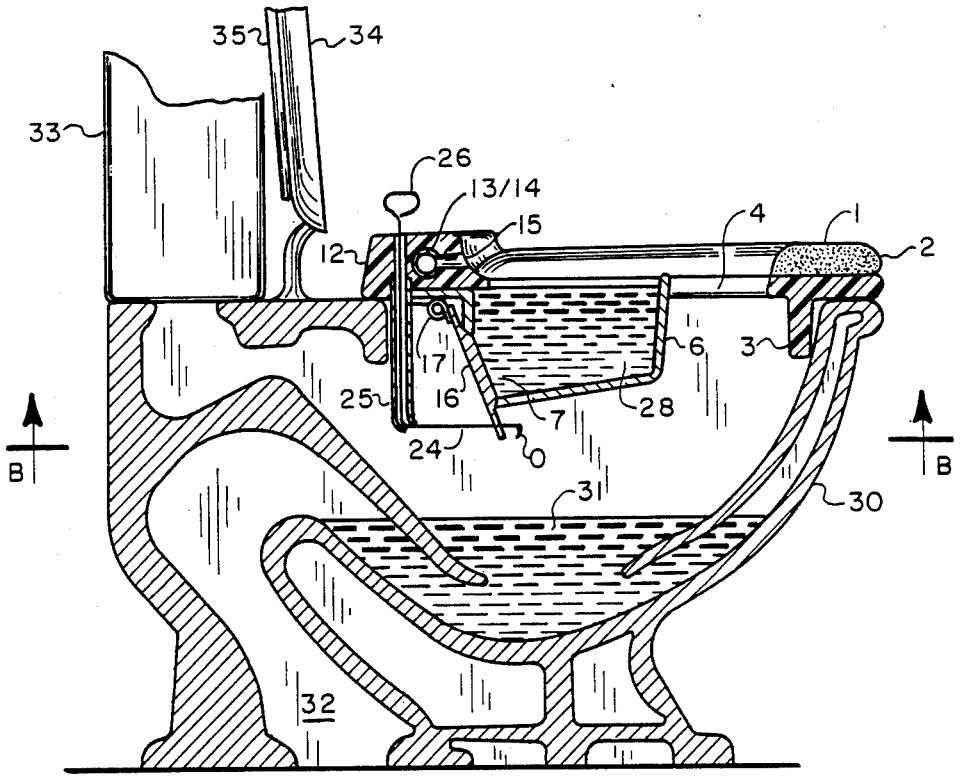
FIG. 1 is a cross-section of a conventional toilet taken along section lines AA of FIG. 2 and showing mounted thereon the adapter unit that constitutes the present invention.
Figure 2:
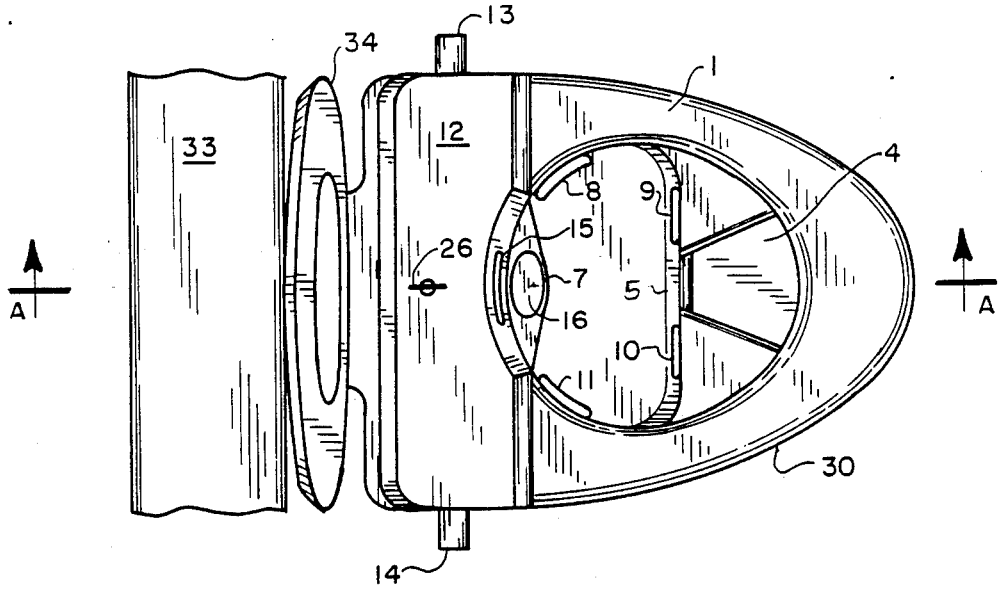
FIG. 2 is a top view of a toilet equipped with the adapter unit of the present invention.

Referring now to FIGS. 1 and 2, the apparatus of the present invention which is designed to facilitate evacuation of the bowel and sigmoid colon to overcome functional constipation and similar problems is shown mounted on a conventional toilet 30 containing water 31 therein, an outlet 32 for the toilet, watertank 33 with toilet seat 34 and an associated cover 35 shown in the upright or folded back position.

Located on the toilet is the adapter unit 1 which includes a padded seat portion 2 and in the upper front portion thereof a retaining ridge or ledge 3 which engages the inside of the toilet bowl 30. The adapter unit fits over the entire opening of a conventional toilet bowl. Included in the adapter of the present invention is the bowl portion 6 which is open on top with the walls thereof all generally inclined inward in a downward direction. The bottom also slopes downward toward the rear of the bowl unit.

Figure 3:
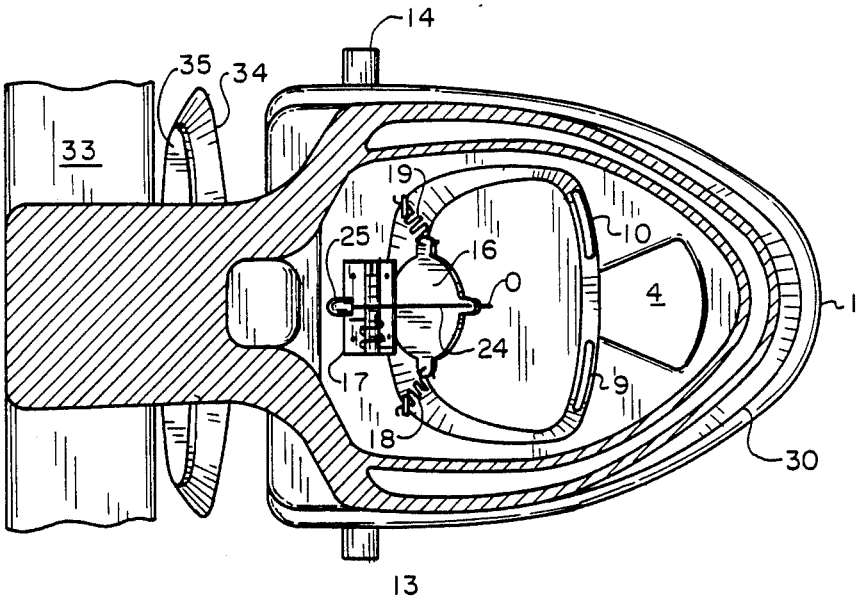
FIG. 3 is a cross-sectional view of a conventional toilet taken along section lines BB of FIG. 1 and looking upward and showing an adapter unit in accordance with the present invention mounted thereon.

Included in the rear wall of the bowl unit is an opening 7 of approximately 4" in diameter. This bowl opening is normally blocked by an automatically closing stopper element 16 which provides a waterproof seal to the bowl unit opening 7. As may be seen in FIG. 1, the stopper element is connected to an external loop or ring 26 by means of a cable or cord 24 which passes through a tubular conduit 25 and which facilitates the opening of the stopper from its position against the opening 7 of the bowl unit 6. The stopper is equipped with a spring hinge 17 as well as auxiliary springs 18 and 19 all of which assist in keeping the stopper in the closed position against opening 7. As may be seen by reference to FIG. 3, the auxiliary springs 18 and 19 are fastened at one end each to the stopper 16 and at the other end to the bowl 6. Also included in the adapter unit of the present invention is a fan-shaped opening 4 to accommodate the genitals for passing urine directly into the bowl of the toilet to keep the warm water from becoming roiled.

It should be further noted that the bowl portion 6 of the present invention is of such construction that the opening tapers from the front wall to the back with the largest distance from right to left in the present embodiment being approximately 10" and that from front to back being about 7½". In the embodiment of the present invention it is shown there is no clear division between the bottom and two lateral side walls, the bottom being a continuation of the lateral walls or vice versa. The two lateral side walls extend downward and incline inward gradually approaching and meet each other to form the bottom. This bottom portion then tapers and slopes downward from the front wall to meet the back wall to facilitate emptying the bowl through the opening 7 contained in the rear wall as discussed previously. It should then be noted that there is a recess 5 in the top of the front wall of the bowl 6 as a continuation of the fan-shaped opening 4 in the front portion of the adapter unit forming the urination passage.

As may be seen by reference to FIG. 2 the adapter unit is equipped with four spillways for overflow of water from bowl 6; these spillways being designated 8, 9, 10 and 11 and being positioned one on either side of the passage reserved for urination and one on each lateral wall adjacent to the back wall of the bowl 6.

Figure 4:
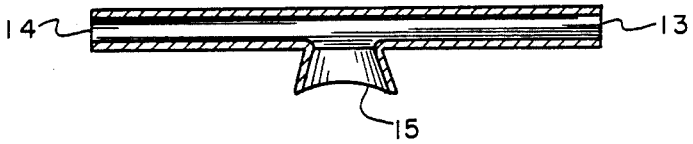
FIG. 4 is a cross-sectional view of the water channel included in the adapter unit of the present invention.

A particular feature of the present invention is the inclusion of a running warm water supply system contained within block 12 as seen in FIG. 2 as well as shown in cross section in FIG. 1. Included therein as may be seen in FIG. 1 is a channel which extends from one side of the adapter unit to the other with an opening 13 located on one side as well as an opening 14 on the other. As may be seen in FIG. 4, an outlet 15 extends from the channel extending between openings 14 and 13; this opening being slit-like in appearance and about 1" in breadth is connected to the center of the warm water supply channel. In usage either one of the two ends 13 or 14 can be used as inlet for warm water connected from a faucet (or other source of water usually available in or adjacent to a bathroom) by means of conventional state of the art adapters with a connecting tube while the other end of the unit such as 13 or 14 is plugged as a dead end.

The adapter unit of the present invention is a portable device as noted previously to encourage and facilitate successful bowel evacuation. When in use it is placed on an ordinary toilet bowl 30 with one end, for example 13, of the water supply being connected to a faucet supplying warm water by means of an adapter with tubing with the other end being plugged. The warm water is then caused to exit through a warm water opening 15 which is used to fill the bowl 6 which is utilized as a warm water bath to assist in successful bowel evacuation. It has been determined that water temperatures in the nature of 90° F. to 122° F. are most generally beneficial for this purpose. Generally speaking, the higher the temperature of the warm water bath the better its effect in strengthening the defecation mechanism and promoting its function. However, each user should choose his or her own optimum temperature.

As noted previously, the user of the adapter unit of the present invention sits on the bowl 6 with the annus immersed in the warm water up to and above the coccyx and with the warm water opening aimed at the region above the coccyx of the user as a supplementary means to assist in bowel evacuation. After defecation, waste matter may be evacuated into the warm water bath in the bowl which is then emptied into the toilet bowl at any desired time. This is accomplished by pulling the handle or ring 26 in an upward direction. After emptying the bowl 6 the opening 7 will automatically be closed by the stopper 16. As noted previously, an opening is provided to facilitate the direct passage of urine into the toilet bowl, since if urine were to be passed into the warm water bath bowl 6, the urine would be missible with the clean water bath in the bowl. The stream of urine might also disturb stools been evacuated into the bowl causing them to disburse into pieces and become suspended into the bath of diluted urine. Thus the clean clear warm water bath in the bowl would become an infectuous medium, a bath of urine fecal mud which would constitute a serious menace to the urogenital organs and also to successful evacuation.

It will be seen from the foregoing that the present invention consists of a comfortable seat for placement on a conventional toilet unit which includes a warm water bath bowl allowing the user to be able to immerse the anus in warm water up to and above the coccyx bone, at the same time excluding the genitals out of the bowl area. This is done so as that urine may be passed directly into the toilet rather than into the same water bath bowl as waste matter evacuated from the bowel. Of prime importance also is the inclusion of an automatic closing system used after emptying of the bowl to maintain a clean warm water bath portion to assist in the defecation process.

While but a single embodiment of the present invention has been shown, it will be obvious to those skilled in the art that numerous modifications can be made without departing from the spirit of the present invention which shall be limited only by the scope of the claims appended hereto.

What is claimed is:

1. Means for assisting in the evacuation of the bowel and sigmoid colon, including support means and adapter means positioned on said support means, said adapter means comprising:

a seat portion adapted to support a user in a seated position on said seat portion;

an opening through said adapter to facilitate urination by said user;

an open top container adapted to contain therein warm water, said container substantially bowl shaped and positioned so the anus of the user can be positioned into said water up to the coccyx;

a water distribution means comprising a tube-like structure open at each end thereof and including a slit-like aperture located midway between said ends of said tube-like structure;

said water distribution means adapted to be connected to a source of warm water and said slit-like aperture so positioned that water from said source is projected against the acupunctural meridians of defecation of the user.

2. Means for assisting in the evacuation of the bowel and sigmoid colon as claimed in claim 1 wherein:

said bowl portion contains a discharge opening and stopper means positioned to normally maintain said opening closed.

3. Means for assisting in the evacuation of the bowel and sigmoid colon as claimed in claim 2 wherein:

said stopper means are adapted to be manually removed from said discharge opening to facilitate the discharge of the contents of said bowl into said support means.

4. Means for assisting in the evacuation of the bowel and sigmoid colon as claimed in claim 3 wherein:

there is further included means for removing said stopper from said opening, including a cable connected to said stopper located so as to project external of said seat portion and including engagement means fastened thereto whereby the user may effect said manual operation of said stopper.

5. Means for assisting in the evacuation of the bowel and sigmoid colon as claimed in claim 2 wherein:

said stopper is normally retained in said position against said opening by means of a plurality of springs.

6. Means for assisting in the evacuation of the bowel and sigmoid colon as claimed in claim 5 wherein:

said springs include a spring hinge supporting said stopper in position against said opening in said bowl.

7. Means for assisting in the evacuation of the bowel and sigmoid colon as claimed in claim 1 wherein:

said support means comprise a flush toilet.

8. Means for assisting in the evacuation of the bowel and sigmoid colon as claimed in claim 1 wherein:

each of said ends are adapted to be connected to a source of warm water and in the alternative each can be plugged.

9. Means for assisting in the evacuation of the bowel and sigmoid colon as claimed in claim 8 wherein:

one of said ends is connected to a source of warm water and the other end is plugged.

10. Means for assisting in the evacuation of the bowel and sigmoid colon as claimed in claim 1 wherein:

said adapter means further includes overflow means located adjacent to said open top container providing a path for an excess of warm water in said open top container to be channeled to said support means.

11. Means for assisting in the evacuation of the bowel and sigmoid colon as claimed in claim 10 wherein:

said overflow means comprise a plurality of overflow spillways positioned adjacent to said open top container and directed toward said support means.

* * * * *